US009114656B2

(12) United States Patent
Mueller

(10) Patent No.: US 9,114,656 B2
(45) Date of Patent: Aug. 25, 2015

(54) METHOD AND DEVICE FOR EXCHANGING AN ADHESIVE APPLICATION ROLLER

(71) Applicant: Mueller Martini Holding AG, Hergiswil (CH)

(72) Inventor: Hans Mueller, Lauda-Koenigshofen (DE)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 13/779,388

(22) Filed: Feb. 27, 2013

(65) Prior Publication Data

US 2013/0224375 A1 Aug. 29, 2013

(30) Foreign Application Priority Data

Feb. 29, 2012 (CH) ..... 0277/12

(51) Int. Cl.

| | |
|---|---|
| ***B42C 9/00*** | (2006.01) |
| ***B05C 1/00*** | (2006.01) |
| *B05D 5/10* | (2006.01) |
| *B05D 1/28* | (2006.01) |
| *B05C 1/08* | (2006.01) |

(52) U.S. Cl.

CPC . *B42C 9/00* (2013.01); *B05C 1/006* (2013.01); *B42C 9/0012* (2013.01); *B05C 1/0808* (2013.01); *B05C 1/0865* (2013.01); *B05D 1/28* (2013.01); *B05D 5/10* (2013.01)

(58) Field of Classification Search

CPC ..... B42C 9/0012; B42C 9/00; B05C 1/006; B05C 1/0813; B05C 1/0808; B05C 1/08; B05C 1/0865; Y10S 156/908; B05D 1/28; B05D 5/10

USPC ..... 412/33, 37, 8; 118/255, 259, 263, 217, 118/220; 101/148, 350.1, 350.3; 156/578, 156/908; 427/207.1

See application file for complete search history.

(56) References Cited

U.S. PATENT DOCUMENTS 4,019,217 A * 4/1977 Schinke ..... 15/256.53
5,792,308 A * 8/1998 Ryan et al. ..... 156/446

(Continued)

FOREIGN PATENT DOCUMENTS

CH 541438 A 9/1973
DE 2320453 A1 11/1973

(Continued)

OTHER PUBLICATIONS

International Search Report of CH 2772012 dated May 9, 2012 with an English Translation.

*Primary Examiner* — Laura Edwards
(74) *Attorney, Agent, or Firm* — Venable LLP; Robert Kinberg

(57) ABSTRACT

In an apparatus for exchanging a duct roller, a first application roller, rotatable on a joint drive shaft and initially in contact with the duct roller, is swiveled away from the duct roller with a first adjustment element that is connected with the joint drive shaft and to a machine control. The first application roller is exchanged with a second application roller. A spacing between the axes of rotation for the joint drive shaft and the duct roller and a contact pressure between the duct roller and the second application roller are pre-set with a second adjustment element that is also connected to the joint drive shaft and to the machine control. The second application roller is swiveled against the duct roller with the aid of the first adjustment element.

12 Claims, 6 Drawing Sheets

(56) References Cited

U.S. PATENT DOCUMENTS

| | | | | |
|---|---|---|---|---|
| 6,082,257 | A * | 7/2000 | Secor | 101/137 |
| 7,959,394 | B2 * | 6/2011 | Abegglen et al. | 412/37 |
| 2002/0162465 | A1 * | 11/2002 | Steffens et al. | 101/350.3 |

FOREIGN PATENT DOCUMENTS

| | | | |
|---|---|---|---|
| DE | 3502733 | C1 | 2/1986 |
| DE | 4332039 | A1 | 3/1995 |
| EP | 0873882 | A1 | 2/1998 |

* cited by examiner

METHOD AND DEVICE FOR EXCHANGING AN ADHESIVE APPLICATION ROLLER

CROSS-REFERENCE TO RELATED APPLICATION

This application claims the priority of the Swiss Patent Application with No. 00277/12, filed on Feb. 29, 2012, the subject matter of which is incorporated herein by reference.

BACKGROUND OF THE INVENTION

The invention relates to a method and an apparatus, which is used to exchange an application roller for applying glue to the spine of a book block transported in a conveying direction by rolling off the book block spine, and which is aligned with a duct roller that removes glue from a glue container. For this, a first application roller that makes contact with the duct roller is swiveled away from the duct roller, is then exchanged for a second application roller, and this second application roller is subsequently swiveled back against the duct roller, wherein the first and the second glue application rollers have a joint drive shaft and wherein the duct roller and the joint drive shaft for the application rollers respectively have a separate axis of rotation which is arranged substantially normal to the book block conveying direction. The invention furthermore relates to a book production line equipped with such a apparatus.

During a book production operation, the book blocks which still lack a book cover are conveyed with a transporting device while an application roller that operates jointly with a duct roller respectively rolls off the book block spine and, in the process, applies the glue. In a following operational step, the glue applied to the book block spine serves to join the book block to the book cover. Since the spine contour can be straight or rounded, a correspondingly embodied application roller is used in each case. Known application rollers, for example, are therefore embodied either flat or profiled.

These or similar methods and devices are disclosed in European Patent documents EP0873882 A1, the DE3502733 C1 and DE4332069 A1.

In most cases, a new book production order results in a change of format for the books to be produced. Owing to the fact that the application roller for applying glue to the book block spine is respectively designed for a specific book block format, the roller must be exchanged for an application roller that corresponds to the new format in the case of a format change.

In the case of a new book production order for which the format deviates from the previously used book format, the production line must initially be stopped for safety-technical reasons since the exchange, meaning the removal and/or installation of an application roller, can be realized only while the casing is open. The machine is therefore stopped following the application of glue to the spine of the last book block in the previous production order. Once the casing is opened, the previously used application roller is dismantled and a suitable application roller for the new production order is installed. With the known methods, the application roller is always replaced manually.

According to a first known method, the application roller is initially swiveled away from the duct roller with the aid of a manually operated adjustment spindle and is then removed manually, meaning it is axially pushed down from the drive shaft and then transported away. A new application roller is subsequently pushed in the axial direction onto the drive shaft, is locked in place thereon, and is then moved with the manually operated adjustment spindle against the duct roller.

Following the closing of the casing, the production can be restarted and the new production order processed.

According to a second known method, the contact between the application roller and the duct roller is manually interrupted for the exchange operation, using an eccentrically positioned drive shaft, and the new application roller is then moved against the duct roller. Once the eccentric positioning is secured and the casing is closed once more, production can resume and the new production order can be processed.

With the known methods and the known devices for exchanging an application roller, the application roller is moved manually away from and/or against the duct roller. In the process, the application roller to be exchanged, which is located inside the machine, is initially moved far enough away from the duct roller so that during the subsequent operation of pulling the application roller from the drive shaft in the axial direction, its largest outside diameter does not come in contact with the duct roller. The same also applies for the new application roller to be installed in the machine by pushing it in the axial direction onto the drive shaft. Once the new application roller has been moved into place, contact needs to be re-established between the application roller surface and the duct roller, meaning the distance between the rotation axis of the new application roller and the rotation axis of the duct roller and, in particular, the contact pressure between the two rollers must be adjusted correctly. On the one hand it means that the contact pressure needs to be high enough to ensure that glue is transferred from the surface of the duct roller to the surface of the application roller. On the other hand, the contact pressure should not be too high since that would result in unnecessary wear for the application roller. Owing to the fact that moving the application roller away from and/or against the duct roller is manually controlled and the actual spacing and the contact pressure consequently depend on the feeling of the machine operator, a precise reproducibility of the process is not possible and an increase in the wear of the application roller cannot be precluded. In addition, the manual control of the complete exchange operation is relatively time-consuming and the share of time that is required for the changeover is relatively high, especially for smaller production runs.

SUMMARY OF THE INVENTION

It is therefore the object of the present invention to provide a method and a device for exchanging a glue application roller, which method and device permit a faster, more secure and precisely reproducible exchange of the application roller and, in the process, prevent increased wear of the application roller.

The above and other objects are accomplished according to an embodiment of the invention by the provision of a method for exchanging an application roller, which is used to apply glue to the spine of a book block transported in a conveying direction by rolling off the book block spine and which is aligned with a duct roller that removes glue from a glue container, the method including: contacting the duct roller with a first application roller that is rotatable on a joint drive shaft; swiveling away the first application roller from the duct roller with the aid of a first adjustment element of an adjustment mechanism that is connected with the joint drive shaft and is operatively connected to a machine control; exchanging the first application roller with a second application roller on the joint drive shaft wherein the duct roller and the joint drive shaft respectively have an axis of rotation that is positioned substantially normal to the conveying direction; subsequently presetting a spacing between the axis of rotation for the joint drive shaft and the axis of rotation of the duct roller and a contact pressure between the second application roller and the duct roller with aid of a second adjustment element that is also connected to the joint drive shaft and is operatively connected to the machine control; and subsequently swiveling back the second application roller against the duct roller with the aid of the first adjustment element.

According to a further aspect of the invention there is provided an apparatus for exchanging an application roller, used to apply glue to the spine of a book block transported in a conveying direction, by rolling off the spine, the apparatus comprising: a joint drive shaft; a plurality of application rollers respectively mountable on the drive shaft, wherein one of the application rollers is initially arranged on the joint drive shaft aligned and in contact with a duct roller that removes glue from a glue container, wherein the one application roller is swivelable away from the duct roller and exchangeable with a another application roller which is then swivelable back against the duct roller, and wherein the duct roller and the joint drive shaft have respectively a separate axis of rotation which is arranged substantially normal to the conveying direction for the book blocks; and an adjustment mechanism coupled to the joint drive shaft, wherein the adjustment mechanism comprises two adjustment elements that operate jointly and are operatively connectable to a machine control for the apparatus, wherein the joint drive shaft for the application rollers is swivelable by the first adjustment element against the duct roller and wherein the second adjustment element is useable to adjust a 1) spacing between the axis of rotation of the duct roller and the axis of rotation of the joint drive shaft, and 2) a contact pressure between the respective application roller when mounted on the joint drive shaft and the duct roller.

As a result of this design for the device and the corresponding method sequence, the application roller exchange can be carried out safely and precisely reproducible, thereby for the most part excluding increased wear of the application roller. In the process, the swiveling of the respective application roller away from the duct roller and against the duct roller is automated, thereby noticeably lowering the time expenditure for exchanging an application roller and minimizing incorrect manual adjustments.

According to one embodiment of the inventive method, the two adjustment elements of the adjustment mechanism are jointly activated with the aid of the machine control, thus making it relatively easy to realize the method.

A further embodiment of the method according to the invention provides that the first adjustment element is acted upon pneumatically and that the second adjustment element is motor-driven. On the one hand this permits a fast swiveling movement for exchanging the respective application roller while, on the other hand, it makes possible a precise adjustment of the spacing between the rotation axes of the second application roller and the duct roller, and the contact pressure between the second application roller and the duct roller.

According to a different embodiment of the inventive method, the first adjustment element is acted upon pneumatically even after the second application roller has been swiveled against the duct roller, thereby making it possible to press the application roller resiliently against the duct roller. Accordingly, the first adjustment element is acted upon pneumatically even after the second application roller has been moved against the duct roller and the second application roller is embodied such that is can be pressed resiliently against the duct roller. As a result, the first adjustment element used for swiveling the respective application roller is not only used for replacing the application roller, but can advantageously also function as a pneumatic spring during the application of glue to the book block spine which functions to maintain the contact pressure between the application roller and the duct roller, thereby ensuring a constant glue film application.

A different embodiment of the method according to the invention allows adjusting the position in height of a roller for applying glue to a book block if a book block arrives at a different level than that of the preceding book block, while still maintaining the spacing between the rotational axes of the application roller and duct roller, and contact pressure to the duct roller. Owing to the fact that the application roller thus gives way in upward direction, the glue can advantageously be applied with the same quality to book blocks having spines which do not pass the application roller in precisely the same horizontal plane.

According to one embodiment, the drive shaft for the application rollers is designed such that it can be moved along a circular track around the axis of rotation for the duct roller. As a result, a constant glue gap can be maintained even for successively following book blocks having spines that do not pass by the application roller in precisely the same horizontal plane. The glue supply for the application roller can be ensured in this way even if the book blocks pass by the application roller at different positions in height.

For yet another embodiment of the inventive device, the first adjustment element comprises a first longitudinal axis and the second adjustment element comprises a second longitudinal axis, wherein the two longitudinal axes enclose a variable adjustment angle in a vertical plane through the conveying direction. The second adjustment element can thus advantageously be swiveled jointly with the application roller.

For a different embodiment, the apparatus includes a basic frame and a swivel frame, having an axis of rotation and two legs, wherein the joint drive shaft for the application rollers is positioned such that it can swivel inside the swivel frame, and wherein a first leg of the swivel frame is connected to the first adjustment element and a second leg of the swivel frame is connected to the second adjustment element. Lever mechanisms of this type ensure good reproducibility for automated sequences.

The second adjustment element for a different embodiment of the apparatus according to the invention comprises an output side end which is embodied such that it can be supported on a pivoting lever on the basic frame for the apparatus. The swiveling movement of the drive shaft for the application rollers can thus be advantageously restricted and an evasive movement of the application rollers is possible of a projecting book spine.

According to yet another embodiment of the invention, the first adjustment element comprises a pneumatic cylinder while the second adjustment element is provided with a spindle that is operatively connected to an adjustment drive. Thus, in addition to the contact pressure resulting from the spacing between application roller and duct roller, a contact pressure for pushing the application roller away from the duct roller can advantageously be adjusted.

The apparatus according to the invention is advantageously utilized in a book production line.

BRIEF DESCRIPTION OF THE DRAWINGS

These and other features and advantages of the invention will be further understood from the following detailed description with reference to the accompanying drawings, showing in.

DETAILED DESCRIPTION

Figure 1:
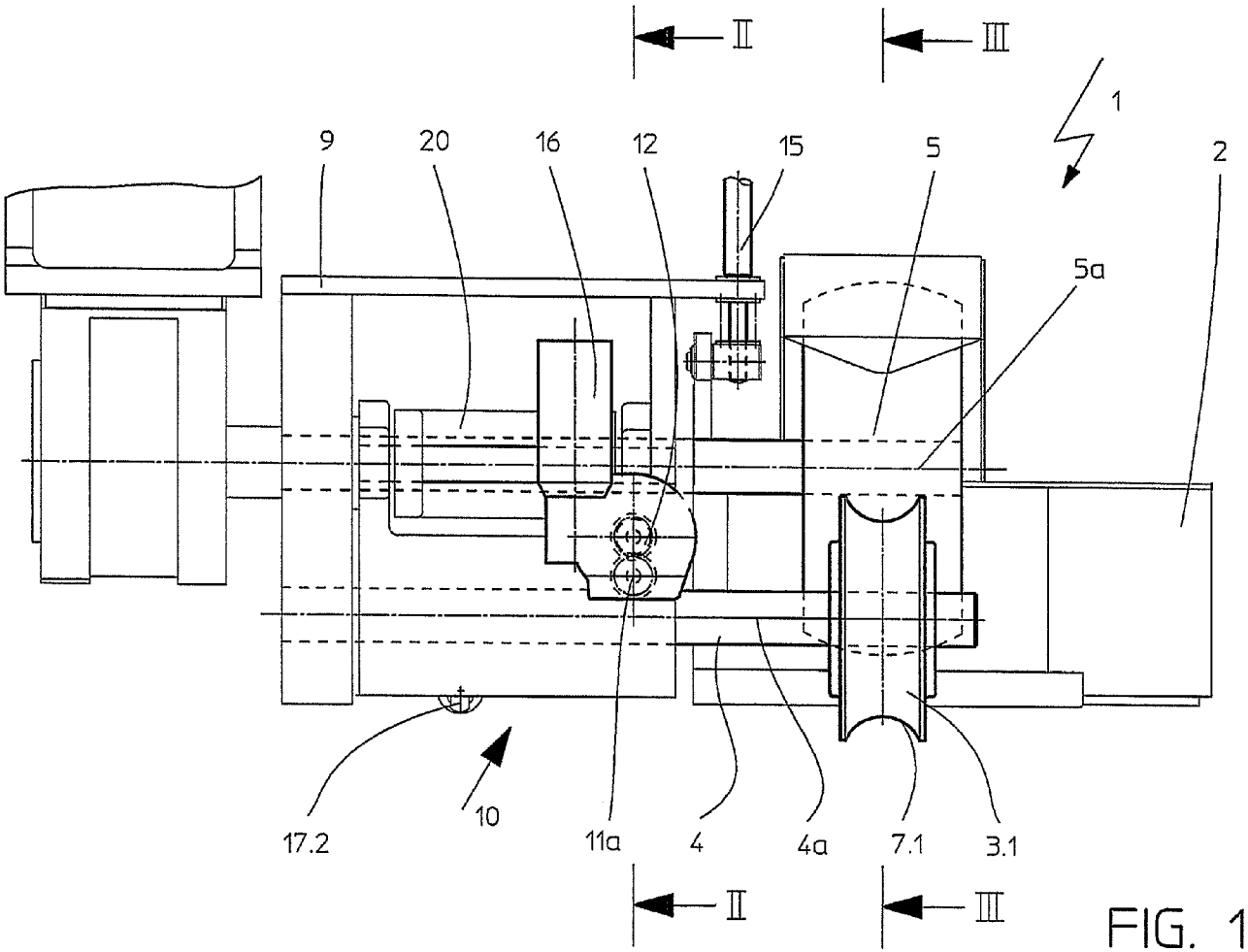
FIG. 1 A view of the front of an apparatus according to the invention, showing a duct roller, a first application roller and an adjustment mechanism.

The Figures show a single exemplary embodiment of an apparatus 1 according to the invention for replacing an application roller, which is used to apply glue to the spine of a book block transported in a conveying direction 8 by rolling off the spine of the book block and which is aligned with a duct roller 5 for removing glue from an glue container 2 as shown in FIG. 1. For this, a first application roller 3.1 which makes contact with the duct roller 5 can be swiveled away from the duct roller 5 and can be exchanged for a second application roller 3.2 which is then swiveled back against the duct roller 5. The first and the second application rollers 3.1, 3.2 have a joint drive shaft 4 that is arranged normal to the conveying direction 8 for the book block.

The apparatus 1 consists of a basic frame 6 (FIG. 2) with therein suspended glue container 2. Also positioned in the basic frame 6 is the duct roller 5 with an axis of rotation 5*a*, which is arranged normal to the conveying direction 8 of the book blocks. The first application roller 3.1 is positioned downstream of the duct roller 5 on the drive shaft 4, as seen in conveying direction 8.

Figure 3:
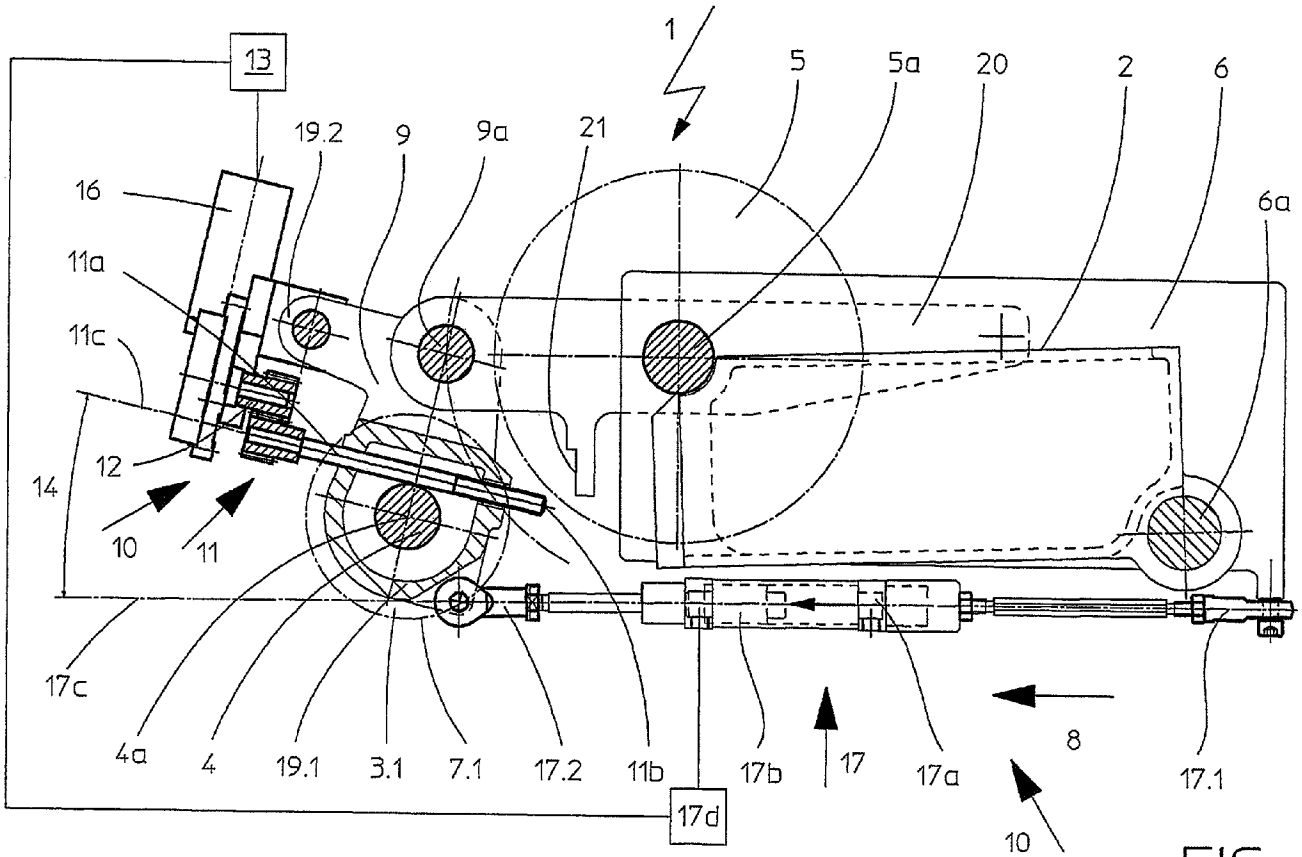
FIG. 3 A representation that corresponds to FIG. 2, wherein the first application roller is swiveled away from the duct roller.
Figure 4:
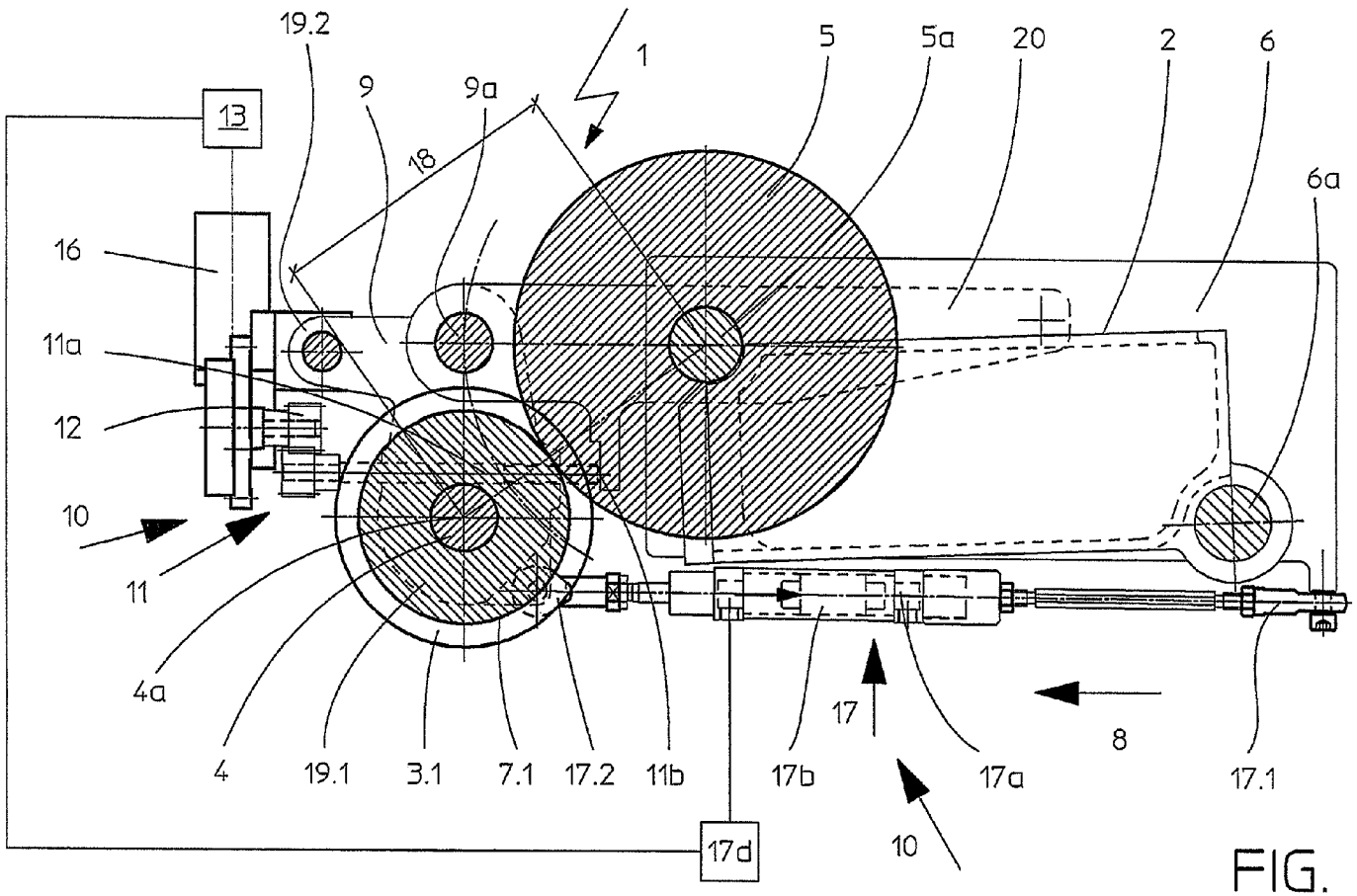
FIG. 4 A section along the line in FIG. 1.
Figure 5:
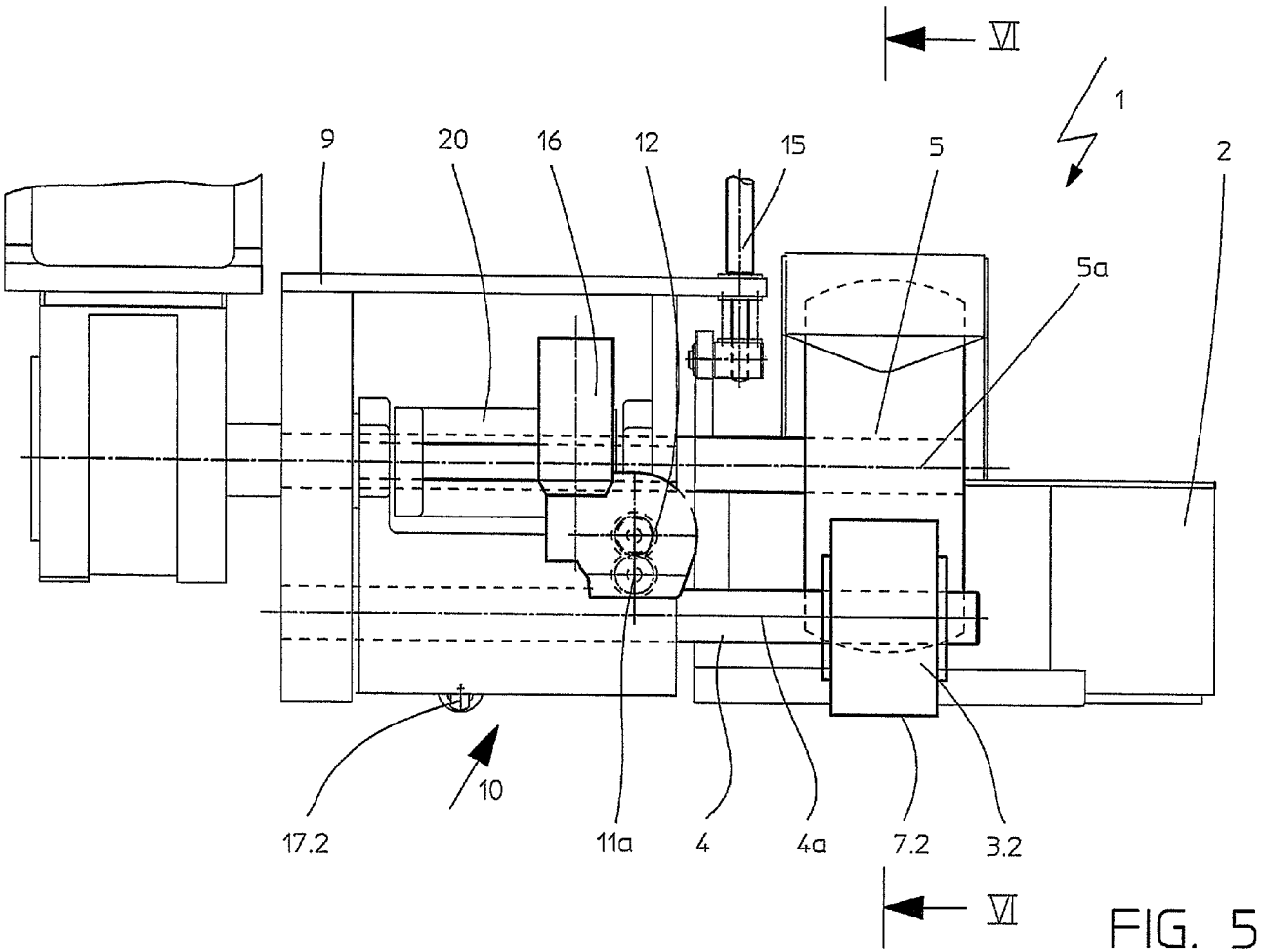
FIG. 5 A view of the front of the apparatus according to the invention, wherein a second application roller is arranged so as to be aligned with the duct roller.

FIGS. 1 and 5 show views of the front of the apparatus 1, wherein respectively a different application roller 3.1, 3.2 is aligned with the duct roller 5. In FIGS. 2, 3, 4 and 6, on the other hand, sectional views are shown which extend through the respective axis of rotation of components of the apparatus 1.

Even though neither the book block nor the transporting device are shown explicitly, a transporting device as well as the position of the book block spine follow explicitly from the Figures as a result of showing the conveying direction 8 and the lower edge of the respective glue-application roller 3.1 or 3.2.

The two application rollers 3.1, 3.2 are embodied differently, meaning the first application roller 3.1 has a rounded outer surface 7.1 while the second application roller 3.2 has a flat outer surface 7.2. Of course, depending on the book blocks to be processed, application rollers with differently embodied outer surfaces as well as application rollers with the same or different size can also be used.

The apparatus 1 furthermore comprises an adjustment mechanism 10 for swiveling the respective application roller 3.1; 3.2 toward and/or away from the duct roller 5. The adjustment mechanism 10 is provided with a first adjustment element 17, comprising a pneumatic cylinder 17*a* that is essentially arranged below the glue container 2 and is oriented along the conveying direction 8. Of course, a different suitable design and a different arrangement of the first adjustment element 17 are possible, for example using a non-depicted, buffered eccentric for moving the respective application roller 3.1; 3.2 against the duct roller 5 and/or away from the duct roller 5.

The drive shaft 4 for the application rollers 3.1, 3.2 is positioned rotating inside a first leg 19.1 of a swivel frame 9 which is located in the basic frame 6. Accordingly, the swivel frame 9 and the drive shaft 4 for the application rollers 3.1, 3.2 have respectively one axis of rotation 9*a*, 4*a* which are arranged so as to be spaced apart. Depending on the actual setting for the first adjustment element 17, these two rotational axes 9*a*, 4*a* are position more or less precisely one above the other in the vertical direction. For example, if the first application roller 3.1 is swiveled against the duct roller 5, then the axis of rotation 4*a* of the first application roller 3.1 is positioned precisely vertically below the axis of rotation 9*a* of the swivel frame (see FIGS. 2 and 4).

Figure 2:
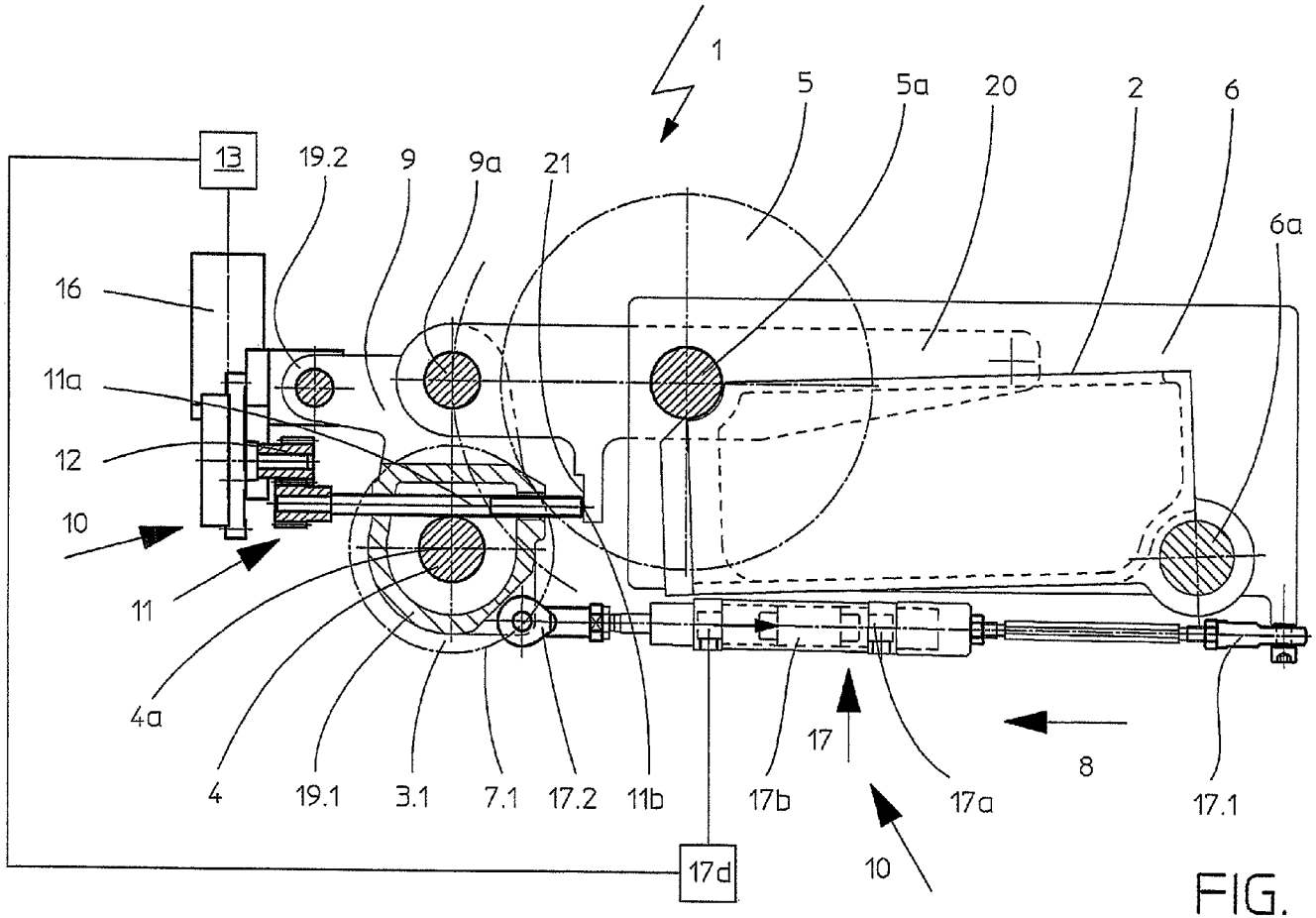
FIG. 2 A section along the line II-II in FIG. 1, wherein the first application roller is in contact with the duct roller.
Figure 6:
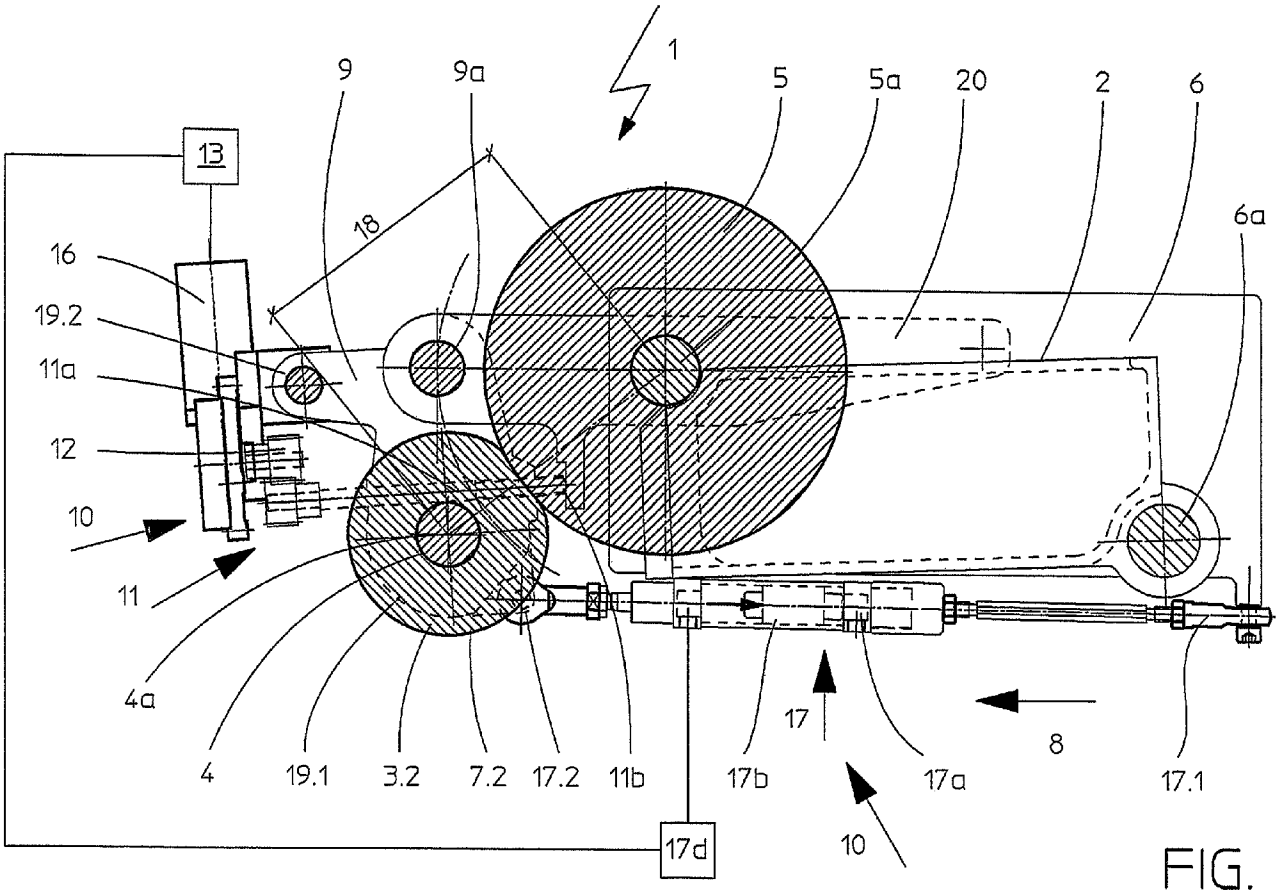
FIG. 6 A section along the line VI-VI in FIG. 5.

The swivel frame 9 furthermore comprises a second leg 19.2, which is facing away from the glue container 2 and extends substantially along the conveying direction 8, on which a second adjustment element 11 of the adjustment mechanism 10 is arranged immovably, relative to the swivel frame, but such that it can be swiveled along with the swivel frame 9. The second adjustment element 11 comprises a spindle 11*a*, which is essentially oriented in the conveying direction 8 and serves to adjust an axial spacing 18 and a contact pressure between the duct roller 5 and the respective application roller 3.1, 3.2 that is moved against the duct roller (FIGS. 4 and 6). The second adjustment element 11 is driven with the aid of an adjustment drive 16 and is operatively connected for this to the adjustment drive 16 via a gear 12 that is also arranged on the second leg 19.2 of the frame 9. An output side end 11*b* of the second adjustment element 11 is embodied such that it can be supported on the basic frame 6. A lever 20 that can pivot around the axis of rotation 5*a* is arranged for this on the basic frame and comprises a stop surface 21 for the output-side end 11*b* of the spindle 11*a* (FIGS. 2 and 3). To adjust the axial spacing 18 between the duct roller 5 and the respective application roller 3.1, 3.2 which is in contact with the duct roller, an adjustment distance for the second adjustment element 11 is specified by a machine control 13 of the apparatus 11 which engages in the adjustment drive 16, wherein this distance is selected based on the respectively used application roller 3.1, 3.2 and the respective book block to be processed.

The pneumatic cylinder 17*a* is attached with a first end 17.1 to the basic frame 6. The pneumatic cylinder 17*a* is connected to the first leg 19.1 of the swivel frame 9 with the aid of a second end 17.2 that is oriented toward the application rollers 3.1, 3.2.

The two adjustment elements 17, 11, meaning the pneumatic cylinder 17*a* and the spindle 11*a*, operate jointly and/or against each other. They respectively have one axis 17*c*, 11*c* wherein these axes jointly enclose a variable adjustment angle 14 in a vertical plane extending through the conveying direction 8 (FIG. 3). The adjustment angle 14 is variable to permit a swiveling of the second adjustment element 11 together with the application rollers 3.1, 3.2. Different diameters for the application rollers 3.1, 3.2 are taken into consideration for the adjustment of the second adjustment element 11, so that the adjustment of the first adjustment element 17 is independent thereof.

The dimensions of the pneumatic cylinder 17*a* are selected such that in the extended state, the respective application roller 3.1, 3.2 is raised far enough off the duct roller 5 to avoid coming into conduct with the duct roller 5 during the exchange of the application rollers. In the fully retracted position, the respective application roller 3.1, 3.2 is pressed by the pneumatic cylinder 17*a* against the duct roller 5.

As soon as the output side end 11*b* of the spindle 11*a* fits against the end stop surface 21 of the pivoting lever 20, arranged on the basic frame 6, during the movement of swiveling the respective application roller 3.1, 3.2 against the duct roller 5, a further swiveling movement of the respective application roller 3.1, 3.2 is delimited by the pneumatic cylinder 17*a* (FIGS. 2, 4 and 6). With a correct pressure adjustment for the pneumatic cylinder 17*a*, the spindle 11*a* with its output side end 11*b* comes in contact with the stop surface 21 on the lever 20, but presses only lightly against this stop surface 21. The stroke length of the pneumatic cylinder 17*a* in this case is selected such that it takes on the function of a pneumatic spring, meaning that a cylinder piston 17*b* of the pneumatic cylinder 17*a* in the retracted state should never reach the end position. As a result, air pressure is present at one side of the piston surface of the cylinder piston 17*b* and the pneumatic cylinder 17*a* acts in the manner of a tension spring, thus making it possible to admit the pneumatic cylinder 17*a* with air even after the respective application roller 3.1, 3.2 is swiveled against the duct roller 5 and the respective application roller 3.1, 3.2 is then pushed resiliently against the duct roller 5. Furthermore possible is a variable adjustment of the contact pressure for the respective application roller 3.1, 3.2 with the aid of a proportional valve 17*d* or a pressure reducer which is not shown herein.

When a book block with an upwardly displaced spine arrives at the respective application roller 3.1, 3.2, the book block spine pushes from below against the respective application roller 3.1, 3.2. The force of the pressure is then introduced via the drive shaft 4 into the swivel frame 9 and via the swivel frame into the lever 20 which pivots around the axis of rotation 5*a* of the duct roller 5, thereby allowing the respective application roller 3.1, 3.2 to evade in upward direction. As a result, the spacing 18 between the axis of rotation 5*a* of the duct roller 5 and the axis of rotation 4*a* of the drive shaft 4 for the application roller 3.1, 3.2 hardly changes because of the pressure force of the pneumatic cylinder 17*a* which ensures that the contact between the spindle 11*a* and the stop surface 21 on the lever 20 is not lost. The position in height of the respective application roller 3.1, 3.2 can thus be adjusted for the application of glue to a book block, which may arrive at a different height position than a previously conveyed book block, while still maintaining the spacing 18 between axes as well as the contact pressure to the duct roller 5 and, in particular, the application roller can evade in an upward direction in case of a projecting book block spine.

Owing to the fact that the spindle 11*a* that is used for changing the axial spacing 18 for the application rollers 3.1, 3.2 is arranged on the swivel frame 9 of the apparatus 1, the spindle can be swiveled jointly with the swivel frame 9 around its axis of rotation 9*a*. As a result, the spindle 11*a* is always ready for use without requiring a change in position, thereby resulting in a cost-effective solution which clearly simplifies the changeover to the following production order.

When processing a current book production order, the duct roller 5 removes glue from the glue container 2 and, in an application position, transfers this glue in the form of a glue film to one of the application rollers 3.1, 3.2 that was previously moved against the duct roller 5. A glue gap, which is not shown herein, is adjusted for this between the duct roller 5 and the glue container 2, wherein the respective application roller 3.1, 3.2 and the duct roller 5 rotate in the same direction. In the application position, the glue film is transferred from the outer surface 7.1, 7.2 of the respective application roller 3.1, 3.2 to the book block spine, wherein the book block and the section of the outer surface 7.1, 7.2 of the application roller which comes in contact with the book block move along the conveying direction 8.

When exchanging an application roller 3.1, 3.2, the first adjustment element 17 is used to swivel the respective application roller 3.1, 3.2 toward and/or away from the duct roller 5. The spacing 18 between the duct roller 5 and the respective application roller 3.1, 3.2 can be adjusted with the aid of the second adjustment element 11. For this, the machine control 13 can preset an adjustment distance for the second adjustment element 11 and thus also a corresponding adjustment distance for the respective application roller 3.1, 3.2, as well as a contact pressure between the application roller 3.1, 3.2 and the duct roller 5. This is advantageous because the duct roller 5 has a convex shape along the circumference and the glue could not be transferred completely without a corresponding adjustment of the respective application roller 3.1, 3.2.

The fact that the machine control 13 has information on the respectively used application rollers 3.1, 3.2 as a result of the available format data for the book blocks to be produced, the required spacing 18 as well as the corresponding contact pressure can advantageously be adjusted ahead of time with the aid of the drives which are operatively connected to the machine control 13. As a result, it is possible to compensate for the relatively large difference between a flat application roller and a round application roller, and an excessively high contact pressure that would lead to increased wear can be avoided for the respective application roller 3.1, 3.2.

If a production order that follows the current production order and, in particular, a resulting change in the book block format requires exchanging the respective application roller 3.1, 3.2, the glue gap for the duct roller 5 is initially reduced to zero in a manner known per se. As a result, the glue remaining on the respective application roller 3.1, 3.2, following the completion of the order for applying glue to the book block spines, is transferred to the duct roller and from there is transported back to the glue container 2. According to FIG. 1, the application roller 3.1 in use until then is swiveled away from the duct roller 5 with the aid of the first adjustment element 17 of the adjustment mechanism 10 which is connected to its drive shaft 4 and operatively connected to the machine control 13. With the aid of the second adjustment element 11 that is also connected to the drive shaft 4 and operatively connected to the machine control 13, the spacing 18 between the axis of rotation 4*a* of the drive shaft 4 for the application rollers 3.1, 3.2 and the axis of rotation 5*a* of the duct roller 5 and a contact pressure are subsequently preset. Once the first application roller 3.1 has been removed from the apparatus 1, meaning it has been removed from the drive shaft 4 in axial direction and transported away, the second application roller 3.2 needed for the following processing order is inserted into the apparatus 1, meaning it is pushed in axial direction onto the drive shaft 4 and is locked in place thereon. The glue gap of the duct roller 5 is then restored and the second application roller 3.2 is once more swiveled against the duct roller 5 with the aid of the first adjustment element 17. For this, the first and the second adjustment elements 17, 11 are correspondingly activated by the machine control 13. The second application roller 3.2 can thus be ready within a short period of time for processing the new order and, for example, to apply glue to book blocks with a different format.

The machine control 13 has information relating to the application rollers 3.1, 3.2 as a result of the format data for the book blocks to be produced. The application rollers 3.1, 3.2 are coded and are provided with corresponding identifying markings which are indicated on a machine display that is not shown herein. The available application rollers 3.1, 3.2 are assigned a specific axial spacing in the machine control 13 which is preset via the spindle 11*a* of the second adjustment element 11 for the position where the application roller 3.1 or 3.2 is swiveled away from the duct roller 5. The steps of adjusting the axial spacing 18 and exchanging the application roller 3.1, 3.2 can take place simultaneously and independent of each other, so that no additional wait time is required. Once the machine operator has uninstalled the currently used application roller 3.1, 3.2 from the machine and replaced it with the application roller 3.2, 3.1 specified by the machine control 13, the operator will enter this information into the machine control 13. The machine control subsequently admits the pneumatic cylinder 17*a* with compressed air, and the installed application roller 3.2, 3.1 is swiveled back against the duct roller 5. The machine is then ready for operation and for processing the following order. The application rollers 3.1, 3.2 are connected via a quick-release coupling, not shown herein, to the drive shaft 4, so that the machine operator can carry out the exchange within a short period of time.

The example in FIG. 1 shows the first application roller 3.1 aligned with the duct roller 5 and moved against this roller while the example in FIG. 5 shows the second application roller 3.2 aligned with the duct roller and moved against it, so that glue can be applied to book blocks with rounded spines as well as book blocks with straight spines.

In FIG. 6, the second application roller 3.2 is in an application position for which it has been moved against the duct roller 5, following the exchange for the application roller 3.1. The spacing 18 is selected such that the duct roller 5 depresses the outer surface 7.2 of the second application roller 3.2. The outer surface 7.2 in the process assumes the shape of the duct roller 5, so that glue is transferred to the complete surface of the rotating roller 3.2 which is driven in the same direction.

The basic frame 6 for the apparatus 1, which accommodates the glue container 2 and the duct roller 5, is provided with an upstream arranged swivel axis 6*a*. With the aid of this swivel axis 6*a* and an additional adjustment drive 15, the glue container 2 can be raised and/or lowered (FIGS. 1 and 5). The glue gap to the duct roller 5 can thus be adjusted via the additional adjustment drive 15.

It will be understood that the above description of the present invention is susceptible to various modifications, changes and adaptations, and the same are intended to be comprehended within the meaning and range of equivalents of the appended claims.

What is claimed is:

1. An apparatus for exchanging an application roller, used to apply glue to the spine of a book block transported in a conveying direction, by rolling off the spine, the apparatus comprising:

a duct roller having an axis of rotation and operatively arranged to remove glue from a glue container, a joint drive shaft;

a plurality of application rollers respectively mountable on the joint drive shaft, wherein one of the application rollers is initially arranged aligned and in contact with the duct roller for application of glue transferred from the duct roller to the spine of the book block, wherein the joint drive shaft is swivelable away from the duct roller to a position exchangeable with another application roller which is then swivelable back against the duct roller, and wherein the duct roller and the joint drive shaft have respectively a separate axis of rotation which is arranged substantially normal to the conveying direction for the book blocks;

a machine control for the apparatus; and an adjustment mechanism connected to the joint drive shaft for the application rollers, wherein the adjustment mechanism comprises first and second, adjustment elements that operate jointly and are operatively connectable to the machine control for the apparatus, wherein the joint drive shaft for the application rollers is swivelable by the first adjustment element, under control of the machine control, against the duct roller, and the second adjustment element is adapted to adjust, under control of the machine control, 1) a spacing between the axis of rotation of the duct roller and the axis of rotation of the joint drive shaft, and 2) a contact pressure between the duct roller and a respective application roller mounted on the joint drive shaft.

2. The apparatus according to claim 1, wherein the joint drive shaft is arranged to move along a circular path around the axis of rotation of the duct roller.

3. The apparatus according to claim 1 wherein the first adjustment element comprises a first longitudinal axis and the second adjustment element comprises a second longitudinal axis, wherein the first and second longitudinal axes enclose a variable adjustment angle in a vertical plane through the conveying direction.

4. The apparatus according to claim 1, further including a basic frame and a swivel frame with an axis of rotation and two legs, wherein the joint drive shaft is positioned to swivel in the frame, and wherein a first leg of the swivel frame is connected to the first adjustment element and a second leg of the swivel frame is connected to the second adjustment element.

5. The apparatus according to claim 4, further including a pivoting lever on the basic frame for the apparatus, wherein the second adjustment element comprises an output-side end which is adapted to be supported on the pivoting lever.

6. The apparatus according to claim 4, further including an adjustment drive, wherein the first adjustment element includes a pneumatic cylinder and the second adjustment element includes a spindle operatively connected to the adjustment drive.

7. The apparatus according to claim 6, wherein the pneumatic cylinder is acted upon pneumatically, even after the other application roller is swiveled back against the duct roller and is adapted to be pressed resiliently against the duct roller.

8. A book production line including the apparatus as disclosed in claim 1.

9. A method for exchanging an application roller, which is used to apply glue to the spine of a book block transported in a conveying direction by rolling off the book block spine and which is aligned with a duct roller that removes glue from a glue container, comprising:

providing the apparatus according to claim 1;

contacting the duct roller with the one application roller that is rotatable on the joint drive shaft;

swiveling away the one application roller from the duct roller with the aid of the first adjustment element of the adjustment mechanism that is connected with the joint drive shaft and under control of the machine control;

exchanging the one application roller with the other application roller on the joint drive shaft;

subsequently presetting the spacing between the axis of rotation for the joint drive shaft and the axis of rotation of the duct roller and the contact pressure between the duct roller and the other application roller with aid of the second adjustment element that is also connected to the joint drive shaft and under control of the machine control; and subsequently swiveling back the other application roller against the duct roller with the aid of the first adjustment element, under control of the machine control.

10. The method according to claim 9, including pneumatically acting on the first adjustment element and driving the second adjustment element with a motor.

11. The method according to claim 10, including pneumatically acting on the first adjustment element even after the other application roller is swiveled back against the duct roller and resiliently pressing the other application roller against the duct roller.

12. The method according to claim 11, wherein during the application of glue to a book block that arrives at a height position differing from a position of a preceding book block, the method further includes adapting the height position of the respective application roller while maintaining the spacing between the axis of rotation of the duct roller and the axis of rotation of the respective application roller and the contact pressure to the duct roller.

* * * * *